US006784607B2

(12) United States Patent
Shimada et al.

(10) Patent No.: US 6,784,607 B2
(45) Date of Patent: Aug. 31, 2004

(54) COLOR CATHODE RAY TUBE

(75) Inventors: Koji Shimada, Shiga (JP); Hiromi Wakasono, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 54 days.

(21) Appl. No.: 09/827,393

(22) Filed: Apr. 5, 2001

(65) Prior Publication Data

US 2001/0033129 A1 Oct. 25, 2001

(30) Foreign Application Priority Data

Apr. 25, 2000 (JP) ..... 2000-123746

(51) Int. Cl.[7] ..... H01J 29/80

(52) U.S. Cl. ..... 313/407; 313/402; 313/404; 313/405; 313/482

(58) Field of Search ..... 313/402, 404, 313/405, 407, 482, 85, 92

(56) References Cited

U.S. PATENT DOCUMENTS

| | | | | | |
|---|---|---|---|---|---|
| 3,766,419 | A | * | 10/1973 | Barbin | 313/403 |
| 3,808,492 | A | | 4/1974 | Nagao | |
| 4,002,941 | A | * | 1/1977 | Demmy | 313/402 |
| 4,472,657 | A | * | 9/1984 | Sakurai et al. | 313/402 |
| 4,931,690 | A | * | 6/1990 | Kokubu et al. | 313/407 |
| 5,160,287 | A | * | 11/1992 | Hirasawa | 445/40 |
| 5,196,761 | A | * | 3/1993 | Majima et al. | 313/402 |
| 5,298,832 | A | * | 3/1994 | Jeong et al. | 313/407 |
| 5,594,300 | A | * | 1/1997 | Nosker et al. | 313/402 |
| 5,644,192 | A | * | 7/1997 | Ragland, Jr. | 313/402 |
| 5,917,274 | A | * | 6/1999 | Youn et al. | 313/407 |
| 6,144,149 | A | * | 11/2000 | Youn et al. | 313/407 |
| 6,310,433 | B1 | * | 10/2001 | Youn et al. | 313/402 |

FOREIGN PATENT DOCUMENTS

| | | | | |
|---|---|---|---|---|
| DE | 36 08 646 | | 3/1986 | |
| JP | 52-42056 | | 3/1977 | |
| JP | 58-198825 | | 11/1983 | |
| JP | 62-85592 | | 4/1987 | |
| JP | 6-89671 | | 3/1994 | |
| JP | 06251720 A | * | 9/1994 | H01J/29/02 |

* cited by examiner

*Primary Examiner*—Vip Patel
*Assistant Examiner*—Anthony Perry
(74) *Attorney, Agent, or Firm*—Merchant & Gould P.C.

(57) ABSTRACT

In a color cathode ray tube in which a shadow mask and an inner magnetic shield are supported by a mask frame and an electron shield is provided in the mask frame, at least a part of the electron shield is made to have a smaller anhysteretic magnetic permeability than the shadow mask, the mask frame and the inner magnetic shield when an applied magnetic field is 800 A/m (10 Oe). Since the magnetic resistance of the electron shield increases, it is possible to reduce a leakage magnetic field from a tube-axis-side edge of the electron shield. Thus, a color cathode ray tube that reduces mis-landing due to a terrestrial magnetism and has no color displacement can be provided.

3 Claims, 20 Drawing Sheets

COLOR CATHODE RAY TUBE

BACKGROUND OF THE INVENTION

1. Field of the Invention

The present invention relates to a color cathode ray tube. More specifically, the present invention relates to a color cathode ray tube characterized by a configuration of a mask frame in order to improve image quality, especially color uniformity.

2. Description of Related Art

As shown in FIG. 17, a color cathode ray tube has a glass bulb 13 including a front panel, whose inner surface is provided with a phosphor screen 14, and a funnel. In a neck portion of the glass bulb 13, an electron gun 81 is provided. A shadow mask 1 that is stretched by a mask frame 31 faces the phosphor screen 14. The mask frame 31 has a substantially L-shaped cross-section, and includes a first portion and an inward projecting portion 32; the former stretches the shadow mask 1 and is fixed to the glass bulb 13 and the latter projects toward a tube axis (central axis) side of the glass bulb 13 so as to be substantially in parallel to the shadow mask 1. An inner magnetic shield 2 is fixed to the inward projecting portion 32.

Electron beams 5 corresponding to three colors of R (red), G (green) and B (blue) are emitted from the electron gun 81 and pass through the shadow mask 1 that is located immediately in front of the front panel. Based on the incident angle at the time of this passage, positions at which the electron beams 5 strike the front panel can be restricted. According to these impact positions, therefore, the phosphors of R, G and B separately are applied on the inner surface of the front panel, thereby performing a color selection geometrically, so as to form color images on the phosphor screen 14.

In a regular color cathode ray tube, images are reproduced by an over scan system so that the images are displayed over an entire screen area of the phosphor screen. The amount of this over scan is about 105 to 110% in each of horizontal and vertical directions of the phosphor screen. When the phosphor screen is scanned with such an over scan system, a part of the over-scanning electron beams 5 hits the mask frame 31 supporting the shadow mask 1 and is reflected so as to reach the phosphor screen 14 as shown in FIG. 18, so that a phosphor layer other than that in a predetermined position emits light. This lowers color purity and contrast of the image, thus deteriorating image quality.

In order to prevent the deterioration of the image quality due to this reflected beam, an electron shield 33 conventionally has been formed at a tube-axis-side edge of the inward projecting portion 32 of the mask frame 31 as shown in FIG. 19. Alternatively, as shown in FIG. 20, an electron shield 33 has been provided between the inner magnetic shield 2 and the inward projecting portion 32 of the mask frame 31 so as to protrude beyond the mask frame 31 toward the tube axis side.

However, since the electron shield 33 conventionally has been formed of a magnetic substance, when the cathode ray tube is placed in the presence of a terrestrial magnetism of about 800 A/m (10 Oe), a leakage magnetic field from a front end portion of the electron shield 33 sometimes has caused a phenomenon that the electron beam is subjected to a deflection of its path so as not to strike a desired position of the phosphor layer (mis-landing).

SUMMARY OF THE INVENTION

It is an object of the present invention to provide a color cathode ray tube that prevents mis-landing due to a terrestrial magnetism and has no color displacement.

In order to achieve the above-mentioned object, a color cathode ray tube of the present invention includes a mask frame, a shadow mask fixed to the mask frame, an inner magnetic shield supported by the mask frame, and an electron shield provided in the mask frame. At least a part of the electron shield has a smaller anhysteretic magnetic permeability than the shadow mask, the mask frame and the inner magnetic shield when an applied magnetic field is 800 A/m (10 Oe).

Since this configuration increases the magnetic resistance of the electron shield, magnetic flux flowing toward a front end portion of the electron shield can be suppressed, thereby reducing a leakage magnetic field from the front end portion of the electron shield. Thus, it is possible to provide a color cathode ray tube that reduces the mis-landing due to the terrestrial magnetism and has no color displacement.

Also, it is preferable that the electron shield is formed so as to elongate a front end portion on an electron beam side of the mask frame.

Alternatively, it is preferable that the electron shield is formed of a member different from the mask frame so as to protrude beyond a front end portion on an electron beam side of the mask frame.

Also, it is preferable that a part of the electron shield has a region having a smaller anhysteretic magnetic permeability than the other part when the applied magnetic field is 800 A/m (10 Oe).

With this configuration, it is possible to regulate the magnetic flux flowing from the inner magnetic shield via the mask frame toward the front end portion of the electron shield, thereby reducing the leakage magnetic field from the front end portion of the electron shield.

Furthermore, in the above-described color cathode ray tube, it is preferable that the mask frame includes a L-shaped member having a L-shaped cross-section and a reinforcing member connected with the L-shaped member, and a part of the reinforcing member has a region having a smaller anhysteretic magnetic permeability than the other part when the applied magnetic field is 800 A/m (10 Oe).

With this configuration, it is possible to regulate the magnetic flux flowing from the inner magnetic shield toward the reinforcing member of the mask frame, thereby reducing the leakage magnetic field from the reinforcing member of the mask frame.

Moreover, in the above-described color cathode ray tube, it is preferable that, when an electron beam scans a phosphor screen by 100%, a minimum distance between the electron shield and a path of the electron beam is at least 8 mm.

With this configuration, since the electron beam passes through a region where the leakage magnetic field is weak, the mis-landing can be reduced further.

DESCRIPTION OF THE PREFERRED EMBODIMENTS

Figure 17:
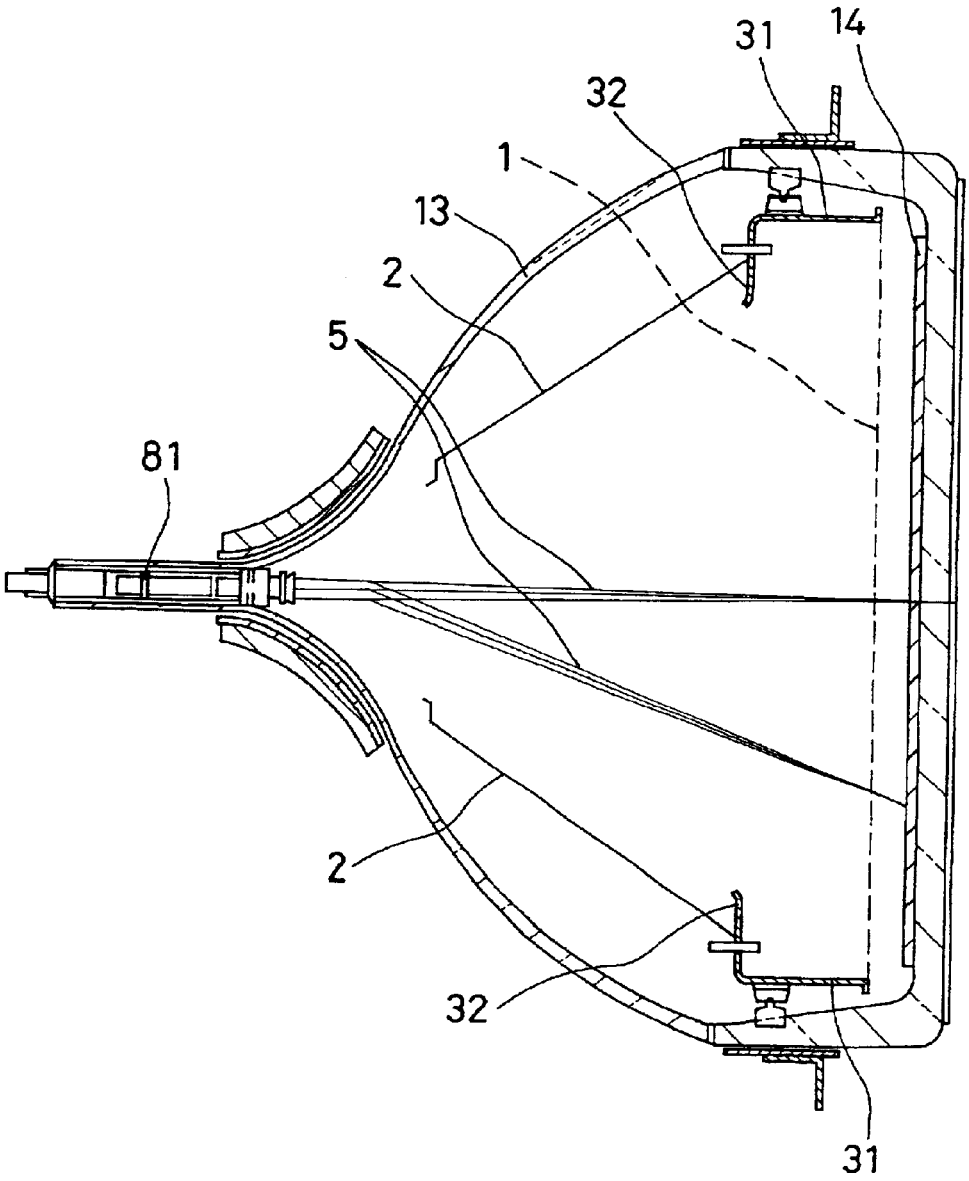
FIG . 17 PRIOR ART
FIG. 17 schematically shows a cross-section of a color cathode ray tube (device).
Figure 18:
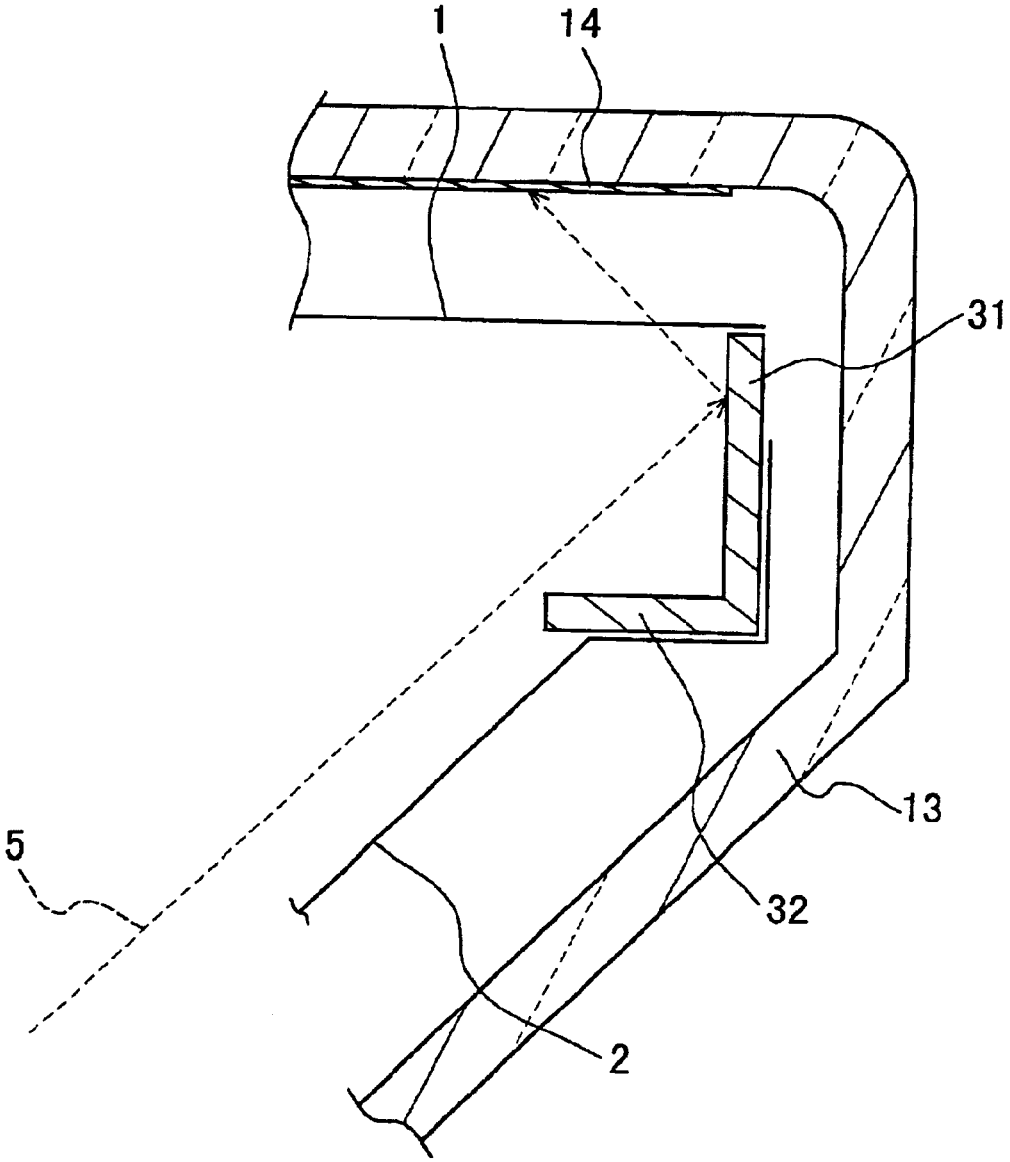
FIG . 18 PRIOR ART
FIG. 18 shows a concept illustrating a path of an over-scanning electron beam.
Figure 19:
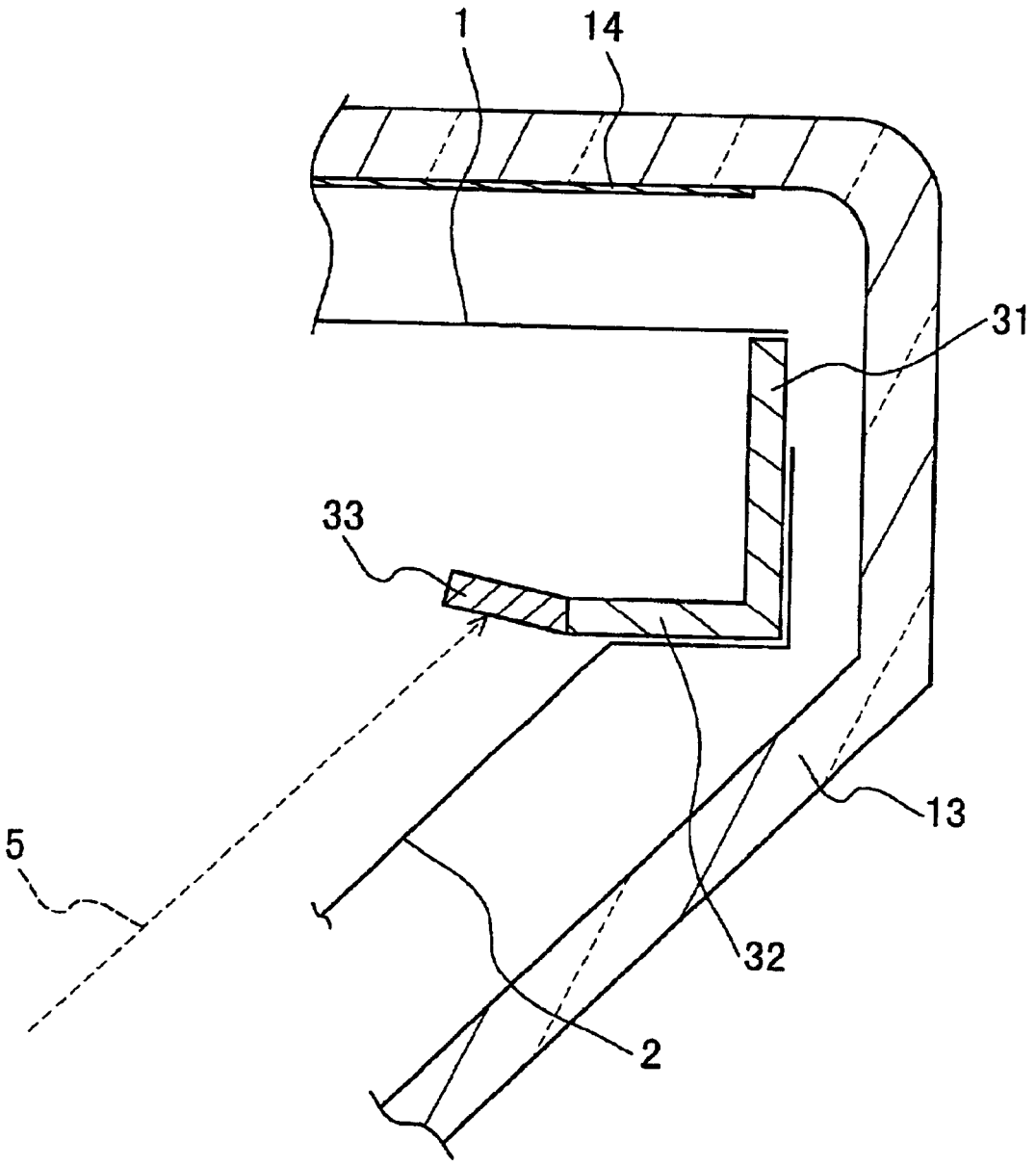
FIG . 19 PRIOR ART
FIG. 19 shows an enlarged cross-section illustrating a main portion of a conventional color cathode ray tube in the vicinity of an electron shield.
Figure 20:
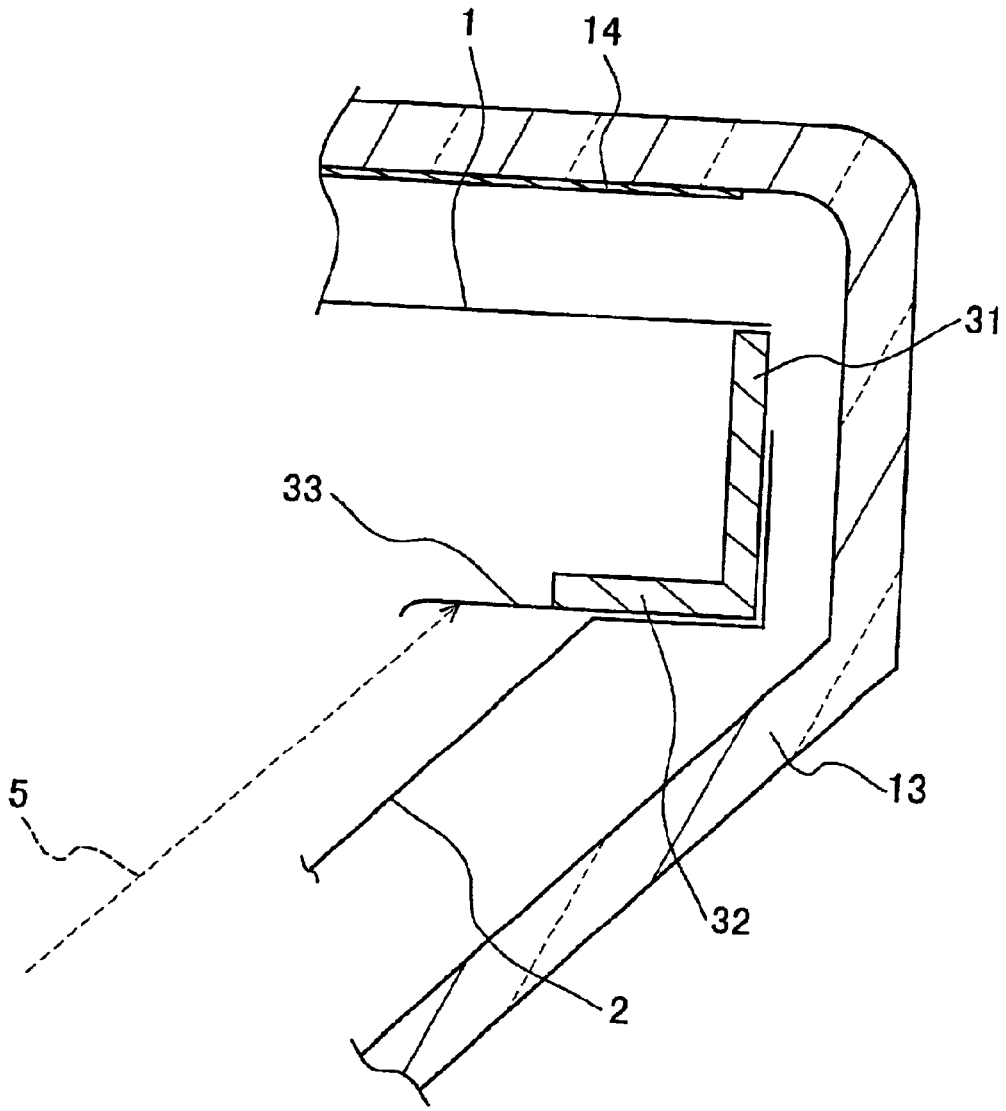
FIG . 20 PRIOR ART
FIG. 20 shows an enlarged cross-section illustrating the main portion of the conventional electron shield as another example.

The following is a specific description of the embodiments of the present invention. A cathode ray tube of the present invention is characterized by its configuration in the vicinity of a mask frame. Since a basic configuration of the cathode ray tube is the same as that of the conventional cathode ray tube shown in FIG. 17, the description of the general configuration will be omitted in the following. Instead, a main portion in the vicinity of the mask frame will be described in detail.

First Embodiment

Figure 1:
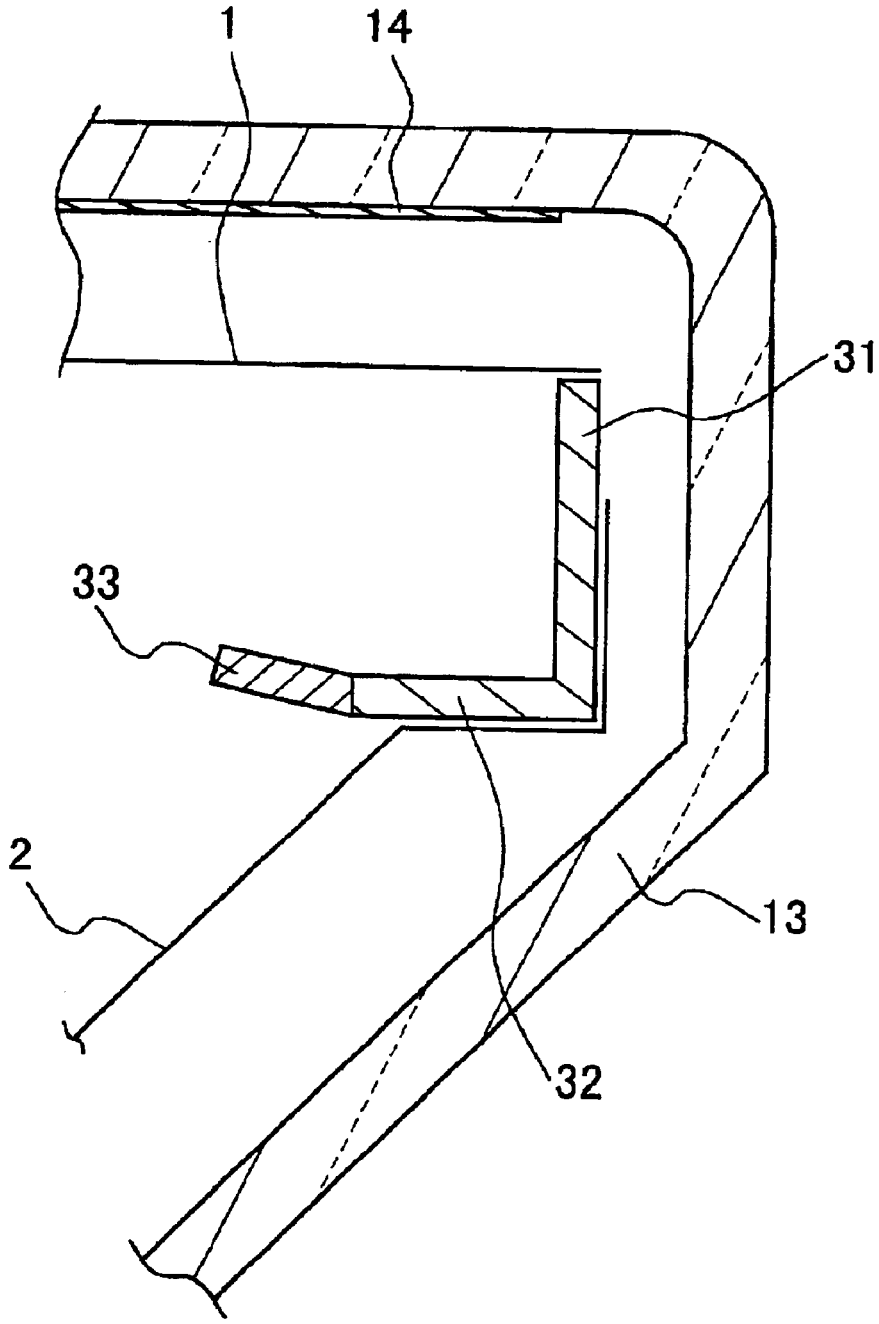
FIG. 1 shows an enlarged cross-section illustrating a main portion of a color cathode ray tube of a first embodiment of the present invention.

FIG. 1 shows an enlarged cross-section of the vicinity of a mask frame 31 in a color cathode ray tube of the present invention.

The mask frame 31 has a substantially L-shaped cross-section, and includes a first portion and an inward projecting portion 32; the former stretches a shadow mask 1 and is fixed to a glass bulb 13 (a fixture is not shown in this figure) and the latter projects toward a tube axis (central axis) side of the glass bulb 13 so as to be substantially in parallel to the shadow mask 1. An inner magnetic shield 2 is fixed to the mask frame 31 (a fixture provided in the inward projecting portion 32 is not shown in this figure).

The tube-axis-side edge of the inward projecting portion 32 is provided with a belt-like electron shield 33 having substantially the same thickness as the inward projecting portion 32 in such a manner as to extend the inward projecting portion 32 along its entire length. The present embodiment is characterized in that an entirety or a part of the electron shield 33 has a smaller anhysteretic magnetic permeability than the shadow mask 1, the mask frame 31 and the inner magnetic shield 2 when an applied magnetic field is 800 A/m (10 Oe) (corresponding to a terrestrial magnetism).

"The anhysteretic magnetic permeability" refers to an effective relative magnetic permeability that can be defined by a magnetic flux density B and a direct current magnetic field H at a convergent point on a hysteresis, which is generated by an anhysteretic magnetization model, when a decaying alternating current magnetic field is reduced to zero. The anhysteretic magnetic permeability is expressed by the following equation.

$$\mu_\mu=(1/\mu_0)\times(B/H)$$

where $\mu_0$ represents a magnetic permeability in a vacuum. The anhysteretic magnetic permeability is described, for example, in The Institute of Electronics, Information and Communication Engineers Transactions C-II, Vol. J79-C-II, No. 6, pp.311–319, June 1996.

Figure 2:
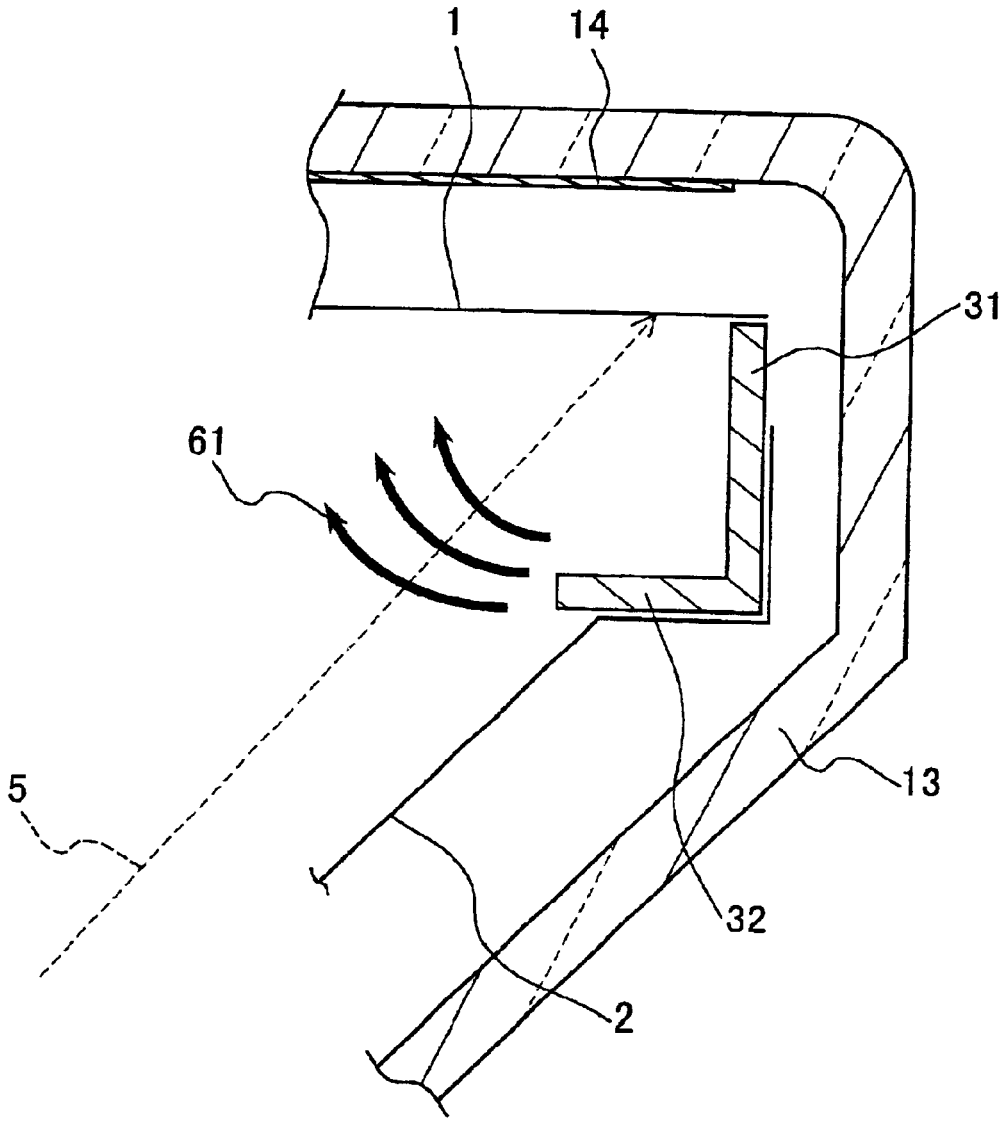
FIG . 2 PRIOR ART
FIG. 2 shows a concept illustrating an effect of a magnetic field in a conventional electron shield.
Figure 3:
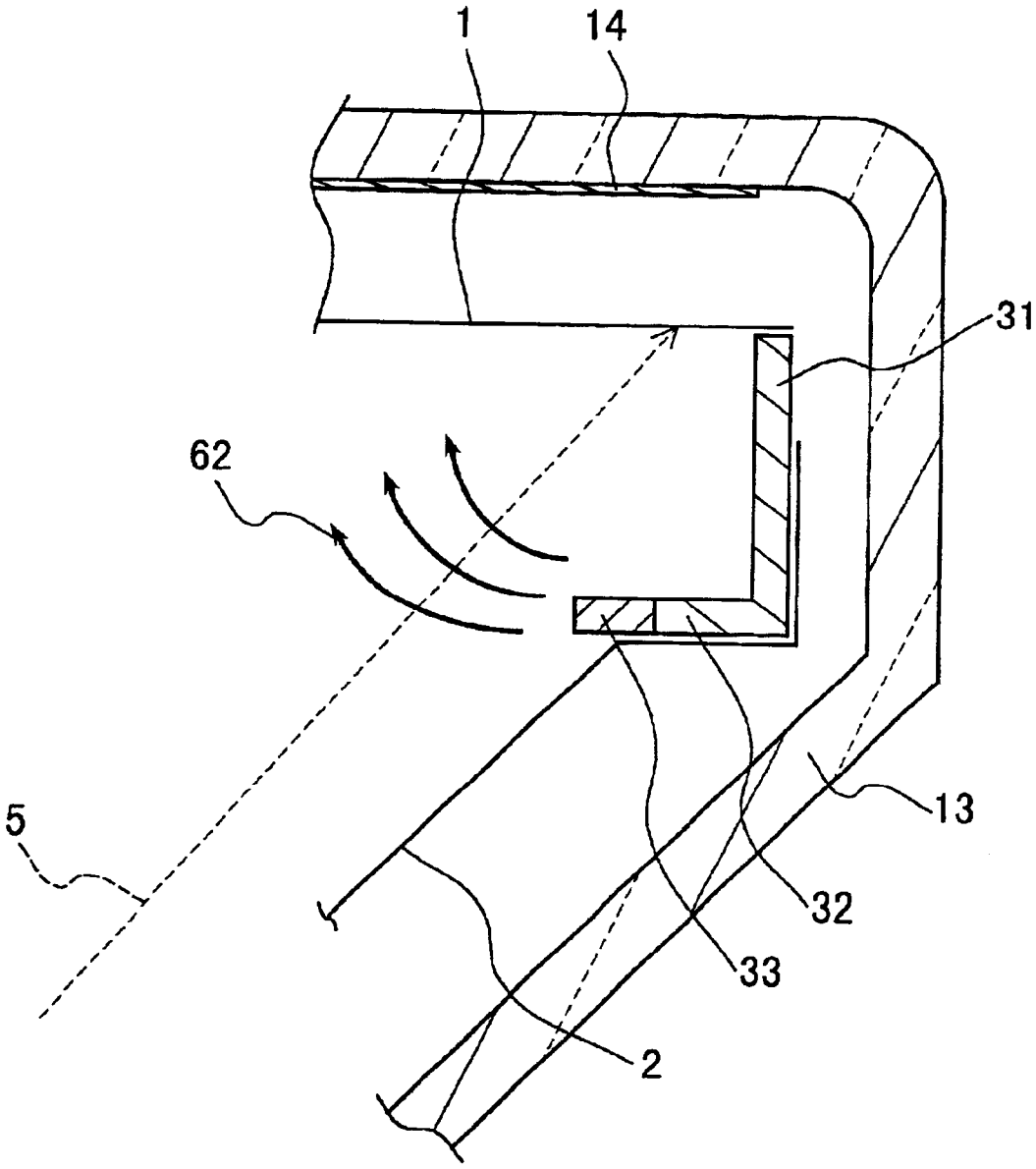
FIG. 3 shows a concept illustrating the effect of a magnetic field in an electron shield of the first embodiment of the present invention.

FIGS. 2 and 3 show an effect of a magnetic field in the mask frame 31. FIG. 2 shows a conventional example, which has the electron shield that is formed integrally with the inward projecting portion 32 at the tube-axis-side edge thereof. This electron shield has the same anhysteretic magnetic permeability as the inward projecting portion 32. FIG. 3 shows a configuration of the present embodiment. Arrows 61 and 62 indicate the state of a leakage magnetic field from the electron shield provided in the inward projecting portion 32 of the mask frame 31. The thickness of these arrows corresponds to the intensity of the leakage magnetic field.

In the conventional example of FIG. 2, magnetic flux flowing via the inner magnetic shield 2 into the mask frame 31 leaks from the inward projecting portion 32 toward the shadow mask 1 in a vacuum (the leakage magnetic field 61). On the other hand, in the present invention shown in FIG. 3, since at least a part of the electron shield 33 provided at the tube-axis-side edge of the inward projecting portion 32 has a smaller anhysteretic magnetic permeability than the shadow mask 1, the mask frame 31 and the inner magnetic shield 2 when the applied magnetic field is 800 A/m (10 Oe), the magnetic resistance between the electron shield 33 and the shadow mask 1 rises, thus reducing the leakage magnetic field 62. Consequently, mis-landing can be reduced.

Members having different anhysteretic magnetic permeability can be fixed to each other by welding, screwing or by using a clamping spring. In FIG. 1, the electron shield 33 is fixed at a certain angle with respect to the inward projecting portion 32. With a suitable angle, it is possible to restrict a path of the electron beam that hits the electron shield 33 and is reflected, thereby preventing the generation of halation.

In the present embodiment, when the applied magnetic field is 800 A/m (10 Oe), the anhysteretic magnetic permeability of a material used for the inner magnetic shield 2 was about 12,000 (soft iron), that for the mask frame 31 was about 2,200 (Fe-36Ni, Fe-42Ni or the like), that for the shadow mask 1 was about 2,000 (Fe-36Ni or the like heat-treated at about 570 to 640° C.), and that for the electron shield 33 was about 1,800 (iron). The anhysteretic magnetic permeability of about 1,800 was obtained by heat-treating an iron material (Fe-36Ni) used for the shadow mask at a relatively low temperature (equal to or lower than 450° C.).

When the electron shield 33 was formed so as to protrude by 20 mm from the tube-axis-side edge of the inward projecting portion 32, the mis-landing was reduced by 2 μm or more compared with the case of FIG. 2 in which the inward projecting portion 32 was extended by the same amount.

Other than the above materials, stainless steel (SUS) or aluminum can be used as the material for the electron shield 33. The anhysteretic magnetic permeability of these materials is about 1 when the applied magnetic field is 800 A/m (10 Oe).

Second Embodiment

Figure 4:
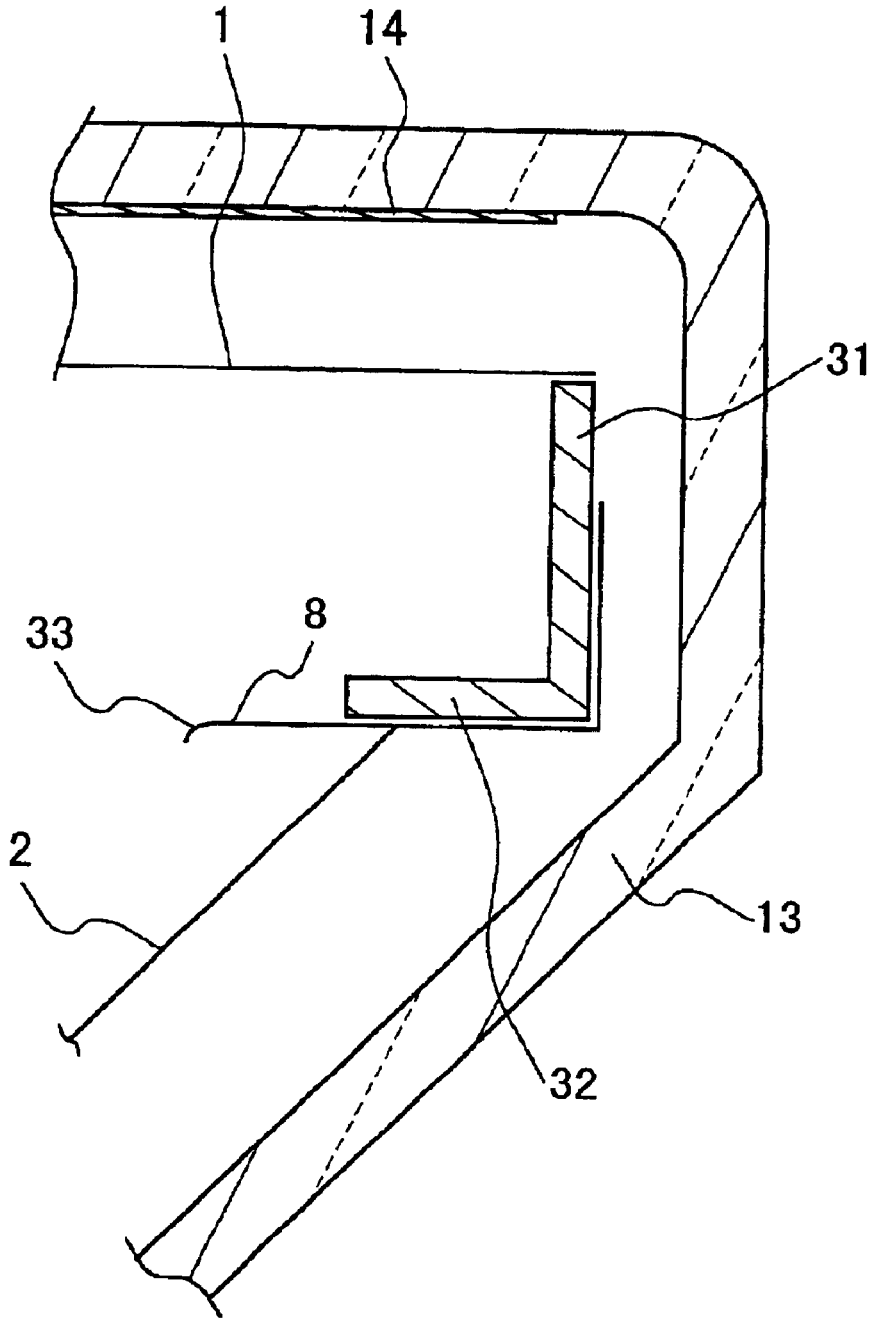
FIG. 4 shows an enlarged cross-section illustrating a main portion of a color cathode ray tube of a second embodiment of the present invention.

As shown in FIG. 4, in the present embodiment, an electron shield 33 formed of a sheet with a thickness of about 0.1 to 0.3 mm is provided on an electron-gun-side surface of an inward projecting portion 32 of a mask frame 31. The electron shield 33 extends substantially over the entire length of the inward projecting portion 32 so as to protrude beyond a tube-axis-side edge of the inward projecting portion 32 by about 30 mm toward the tube axis side. The material of the electron shield 33 is soft iron, which is the same as that of the inner magnetic shield 2. The front end portion on the tube axis side of the electron shield 33 is bent slightly toward the electron gun side, thereby preventing the generation of halation. The anhysteretic magnetic permeability when an applied magnetic field is 800 A/m (10 Oe) is not uniform throughout the electron shield 33, that is, the anhysteretic magnetic permeability in one part 8 is smaller than that in the other part. In the present embodiment, instead of providing a member made of a specific material in the one part 8, the one part 8 of the electron shield 33 is formed to be an aperture (a rectangular hole).

Figure 5:
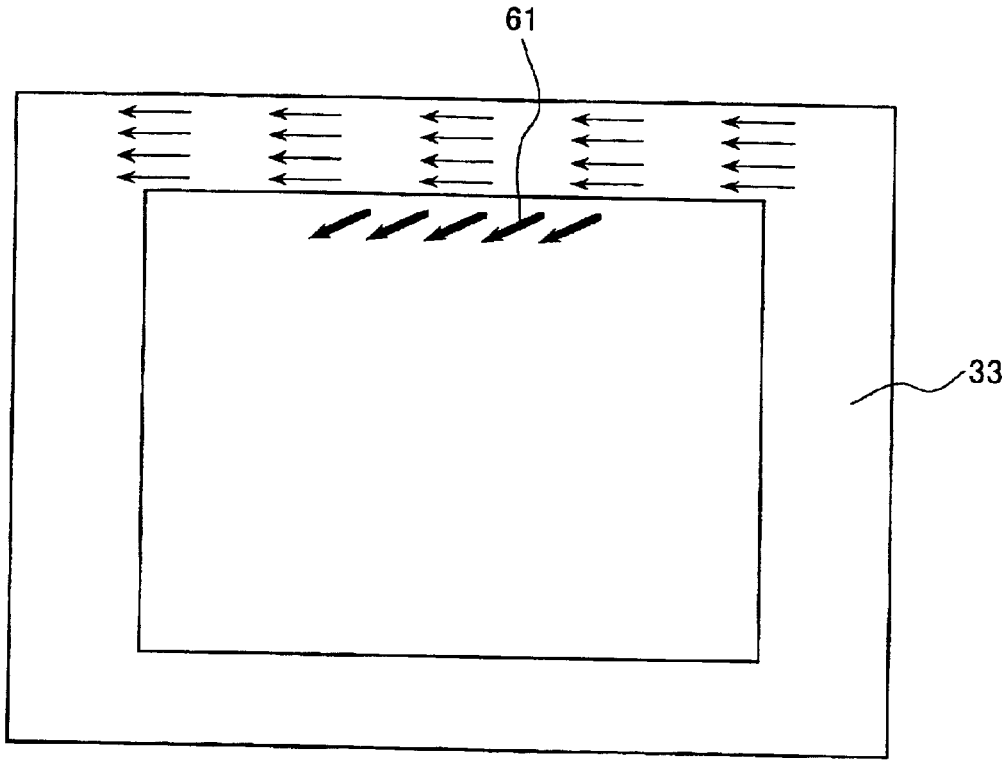
FIG . 5 PRIOR ART
FIG. 5 shows a concept illustrating a state of magnetic flux in the conventional electron shield.
Figure 6:
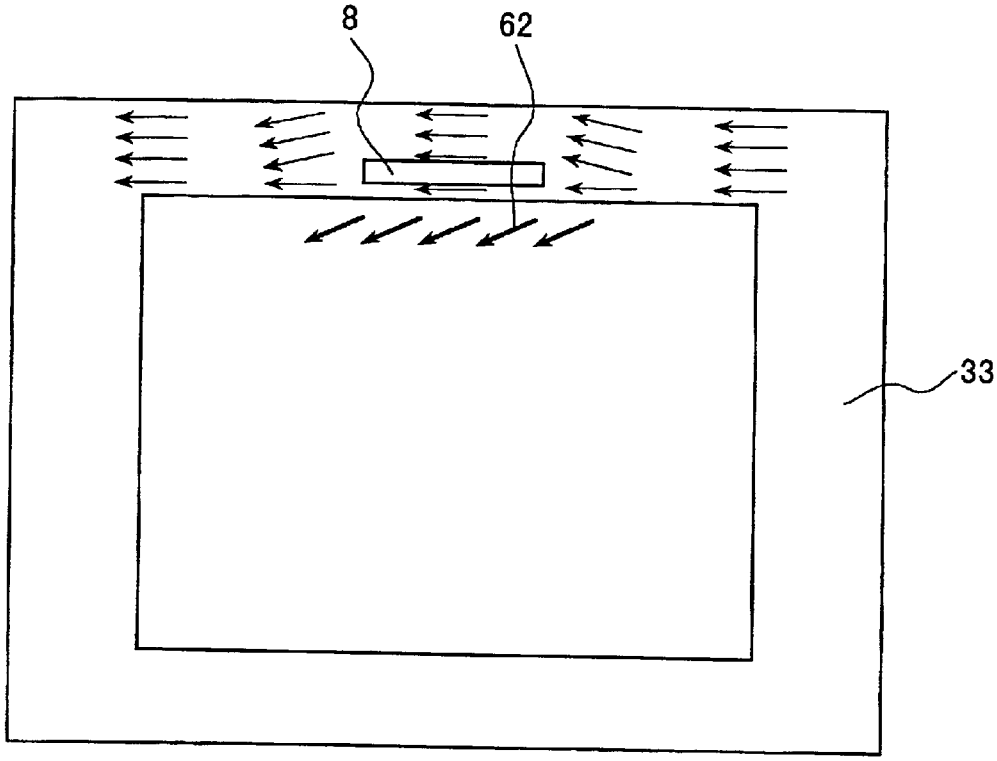
FIG. 6 shows a concept illustrating the state of magnetic flux in an electron shield of the second embodiment of the present invention.

FIG. 5 shows a state of magnetic flux in the conventional electron shield 33, and FIG. 6 shows that in the electron shield 33 of the present embodiment, both seen from the electron gun side. In the conventional example of FIG. 5, the electron shield 33 has no aperture and an anhysteretic magnetic permeability that is uniform throughout its entire area. FIG. 6 shows the present embodiment, whose configuration is the same as that of FIG. 5 except that the aperture 8 is formed. In FIGS. 5 and 6, the state of the magnetic flux in an upper long side alone is shown for simplification of the figure.

In the configuration of the conventional example shown in FIG. 5, the magnetic flux flowing in the electron shield 33 leaks from the electron shield 33 toward the shadow mask 1 in a vacuum. Arrows in the figures indicate the state of the magnetic flux flowing in the electron shield 33 and a leakage magnetic field 61 from the electron shield 33. On the other hand, in the present invention shown in FIG. 6, the magnetic flux flowing from the inner magnetic shield 2 toward a front end of the electron shield 33 (indicated by the arrows in the figure) is regulated by the aperture 8, thereby making it possible to reduce the magnetic flux flowing on the tube axis side (inner side) with respect to the aperture 8 of the electron shield 33. Consequently, a leakage magnetic field 62 from the front end portion of the electron shield 33 can be reduced compared with the conventional configuration (FIG. 5), thus reducing mis-landing.

In the present embodiment, when a rectangular aperture 8 having a width of 2 mm and a length of 25 mm was provided at a distance of 5 mm from an inner edge of the electron shield 33 having a width of 40 mm, the mis-landing on the screen was reduced by 2 μm or more. The anhysteretic magnetic permeability of the aperture 8 is about 1.

Figure 7:
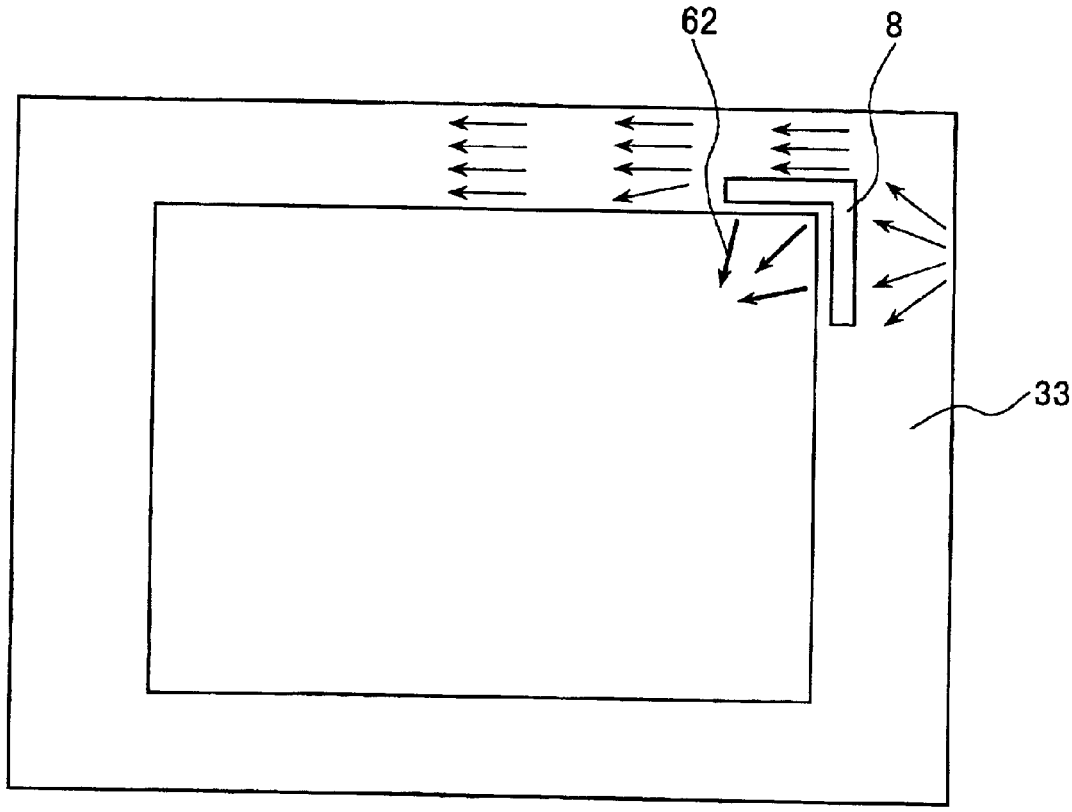
FIG. 7 shows a concept illustrating the state of magnetic flux in an electron shield according to another example of the second embodiment of the present invention.

Also, when an L-shaped aperture 8 having a width of 2 mm was provided at a corner of the electron shield 33 as shown in FIG. 7, the mis-landing at the corner of the screen was reduced by 2 μm or more.

Instead of leaving the aperture 8 open, the aperture 8 may be sealed with a material with a smaller anhysteretic magnetic permeability than the shadow mask 1, the mask frame 31 and the inner magnetic shield 2 when the applied magnetic field is 800 A/m (10 Oe). For such a material, the material used for the electron shield 33 in the first embodiment can be used, for example.

The member or the aperture having a small anhysteretic magnetic permeability may be provided in a suitable size and in a suitable number at a place where it is desired to reduce the leakage magnetic field.

Although FIGS. 5 to 7 showed the magnetic flux flowing horizontally in the electron shield 33, the present embodiment also produces effects similar to the above with respect to magnetic flux flowing in the other directions.

Third Embodiment

Figure 8:
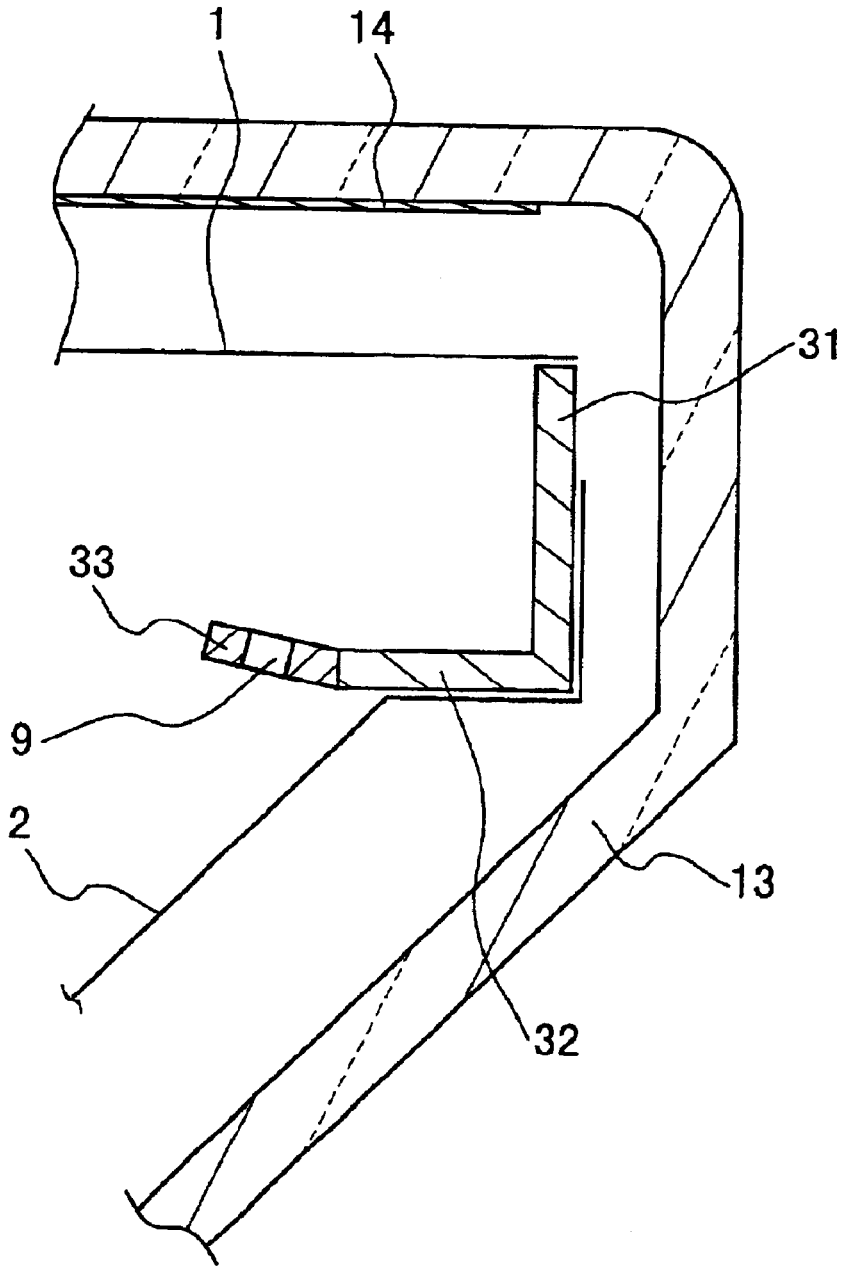
FIG. 8 shows an enlarged cross-section illustrating a main portion of a color cathode ray tube of a third embodiment of the present invention.

As shown in FIG. 8, in the present embodiment, a belt-like electron shield 33 having substantially the same thickness as an inward projecting portion 32 is provided at a tube-axis-side edge of the inward projecting portion 32. The electron shield 33 extends substantially over the entire length of the inward projecting portion 32 so as to elongate the inward projecting portion 32. The material of the electron shield 33 is Fe-36Ni, Fe-42Ni or the like, which is the same as that of a mask frame 31. One part 9 of the electron shield 33 has a smaller anhysteretic magnetic permeability than the other part of the electron shield 33 when an applied magnetic field is 800 A/m (10 Oe) (corresponding to a terrestrial magnetism). More specifically, the one part 9 is formed to have apertures by providing a plurality of holes.

Figure 9:
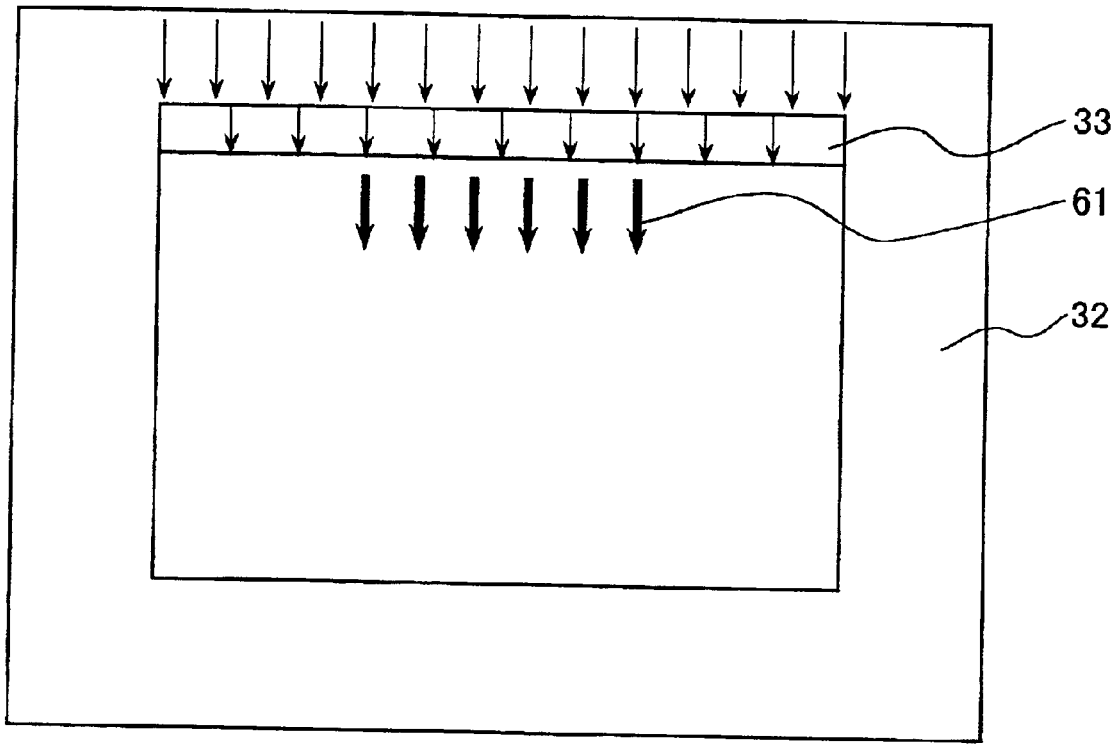
FIG . 9 PRIOR ART
FIG. 9 shows a concept illustrating a state of magnetic flux in an inward projecting portion of a conventional mask frame.
Figure 10:
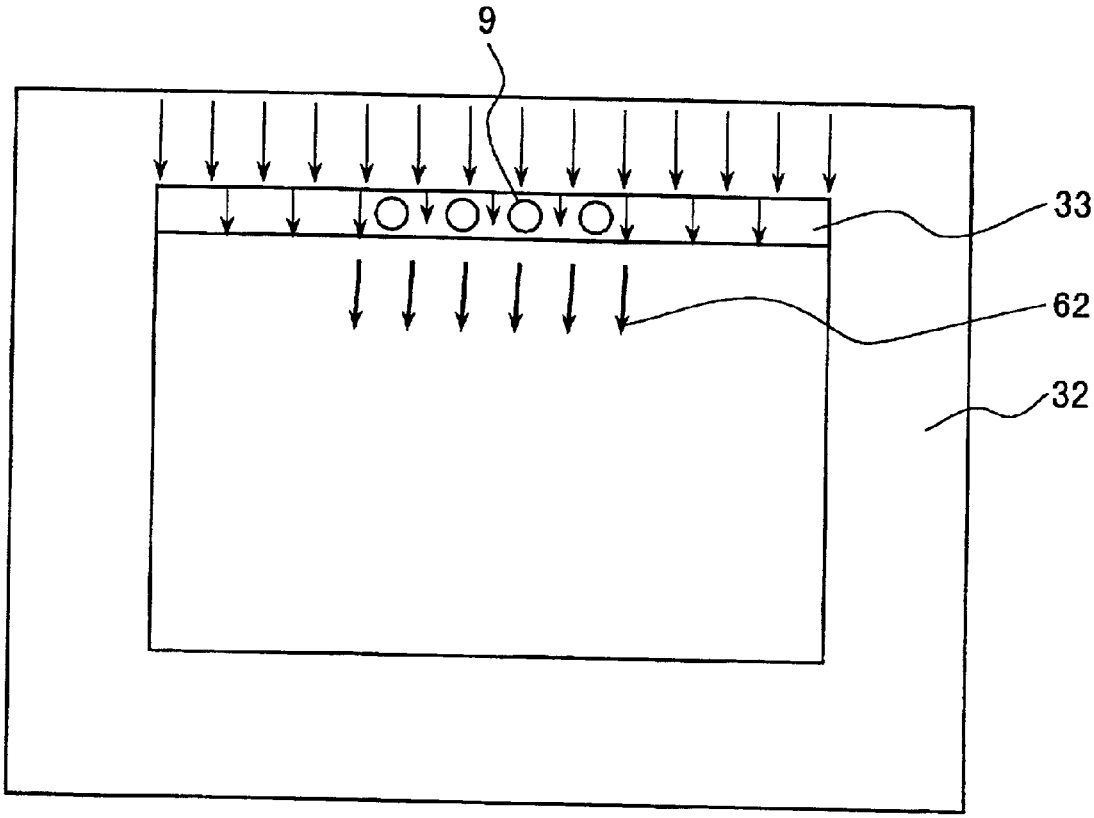
FIG. 10 shows a concept illustrating the state of magnetic flux in an inward projecting portion according to the third embodiment of the present invention.

FIG. 9 shows a state of magnetic flux in the inward projecting portion 32 and the electron shield 33 of the conventional example, and FIG. 10 shows that in the inward projecting portion 32 and the electron shield 33 of the present embodiment, both seen from the electron gun side. In the conventional example of FIG. 9, the electron shield 33 has a uniform anhysteretic magnetic permeability in its entire region. FIG. 10 shows a configuration of the present embodiment, which is the same as that of FIG. 9 except that the apertures 9 are formed in the electron shield 33. Although the electron shield 33 provided in an upper long side alone is shown in FIGS. 9 and 10 for a simplification of the figure, the electron shield 33 actually is provided along the entire perimeter of the tube-axis-side edge of the inward projecting portion 32. Also, FIGS. 9 and 10 show the state of the magnetic flux in the upper long side alone.

In the configuration of the conventional example shown in FIG. 9, the magnetic flux flowing in the inward projecting portion 32 leaks from the electron shield 33 toward the shadow mask 1 in a vacuum. Arrows in FIG. 9 indicate the magnetic flux flowing in the inward projecting portion 32 and the electron shield 33 and the leakage magnetic field 61 from the electron shield 33. On the other hand, in the present invention shown in FIG. 10, one part on the long side of the electron shield 33 is provided with a plurality of the apertures (holes) 9, which have a smaller anhysteretic magnetic permeability than the other part when the applied magnetic field is 800 A/m (10 Oe). This part having a smaller anhysteretic magnetic permeability (the apertures 9) regulates the magnetic flux flowing from the inner magnetic shield 2 via the mask frame 31 toward a front end of the electron shield 33, thereby reducing the magnetic flux flowing on the tube axis side with respect to the part having a smaller anhysteretic magnetic permeability. Consequently, a leakage magnetic field 62 from the front end portion of the electron shield 33 can be reduced compared with the conventional configuration (FIG. 9), thus reducing mis-landing.

In the present embodiment, when a circular aperture 9 having a diameter of 8 mm was provided in four places in the vicinity of the center of the long side of the electron shield 33, the mis-landing on the screen was reduced by 2 μm or more.

The number, position and shape of the apertures 9 may be selected suitably according to purposes.

Instead of leaving the aperture 9 open, the aperture 9 may be sealed with a material with a smaller anhysteretic magnetic permeability than the shadow mask 1, the mask frame 31 and the inner magnetic shield 2 when the applied magnetic field is 800 A/m (10 Oe). For such a material, the material used for the electron shield 33 in the first embodiment can be used, for example.

Fourth Embodiment

Figure 11:
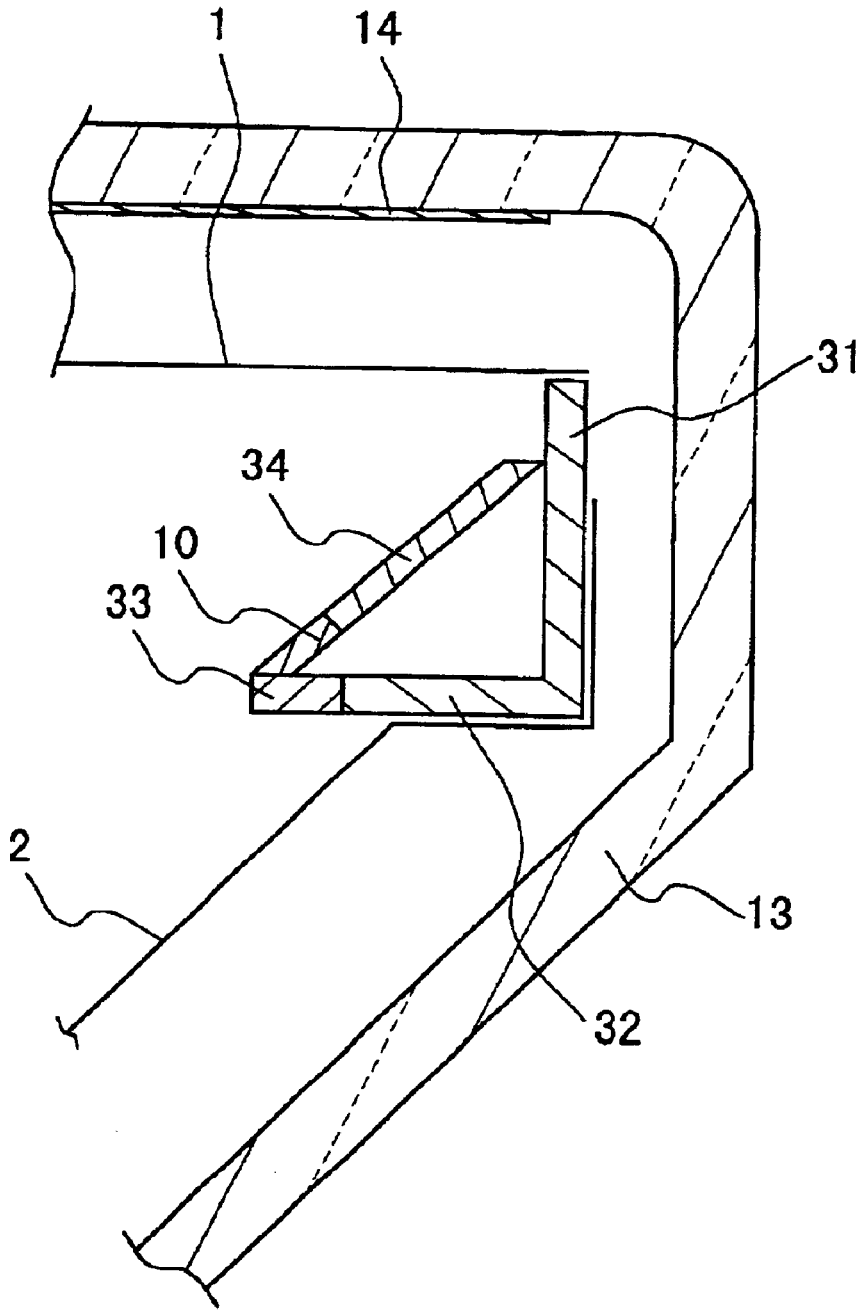
FIG. 11 shows an enlarged cross-section illustrating a main portion of a color cathode ray tube of a fourth embodiment of the present invention.

As shown in FIG. 11, in the present embodiment, not only is an electron shield 33 provided on a tube-axis-side edge of an inward projecting portion 32, but also a reinforcing member 34 formed of a plate material extends over an entire length of a mask frame 31 or is combined with a part thereof such that the mask frame 31 has a triangular cross-section. The reinforcing member 34 has one part 10, which is an edge portion on the tube axis side (the electron shield 33 side), formed of a non-magnetic material throughout its entire length. The one part 10 has a smaller anhysteretic magnetic permeability than the other region when an applied magnetic field is 800 A/m (10 Oe).

Figure 12:
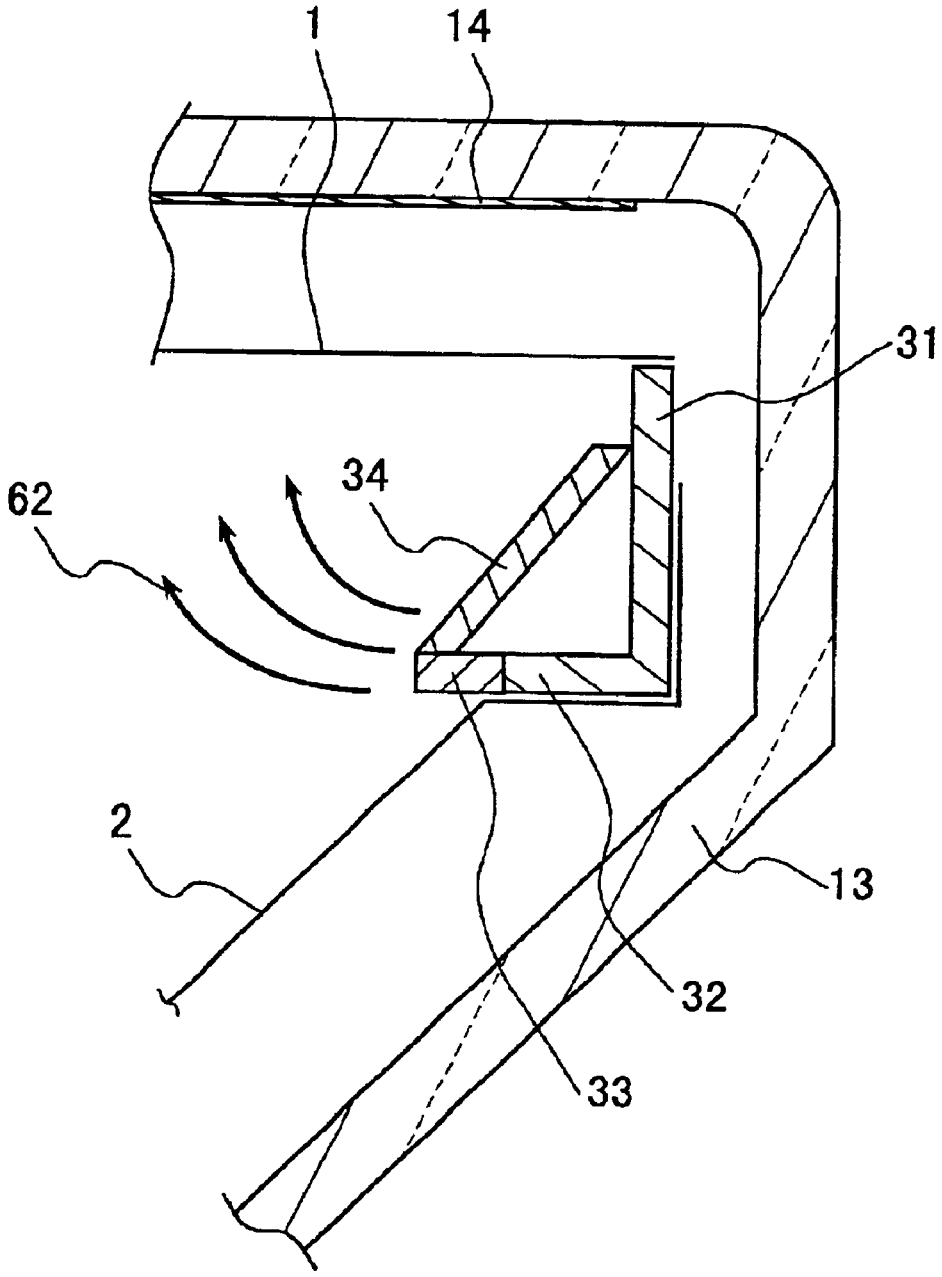
FIG. 12 shows a concept illustrating an effect of a magnetic field in the vicinity of a reinforcing member when a configuration of the fourth embodiment of the present invention is not provided.
Figure 13:
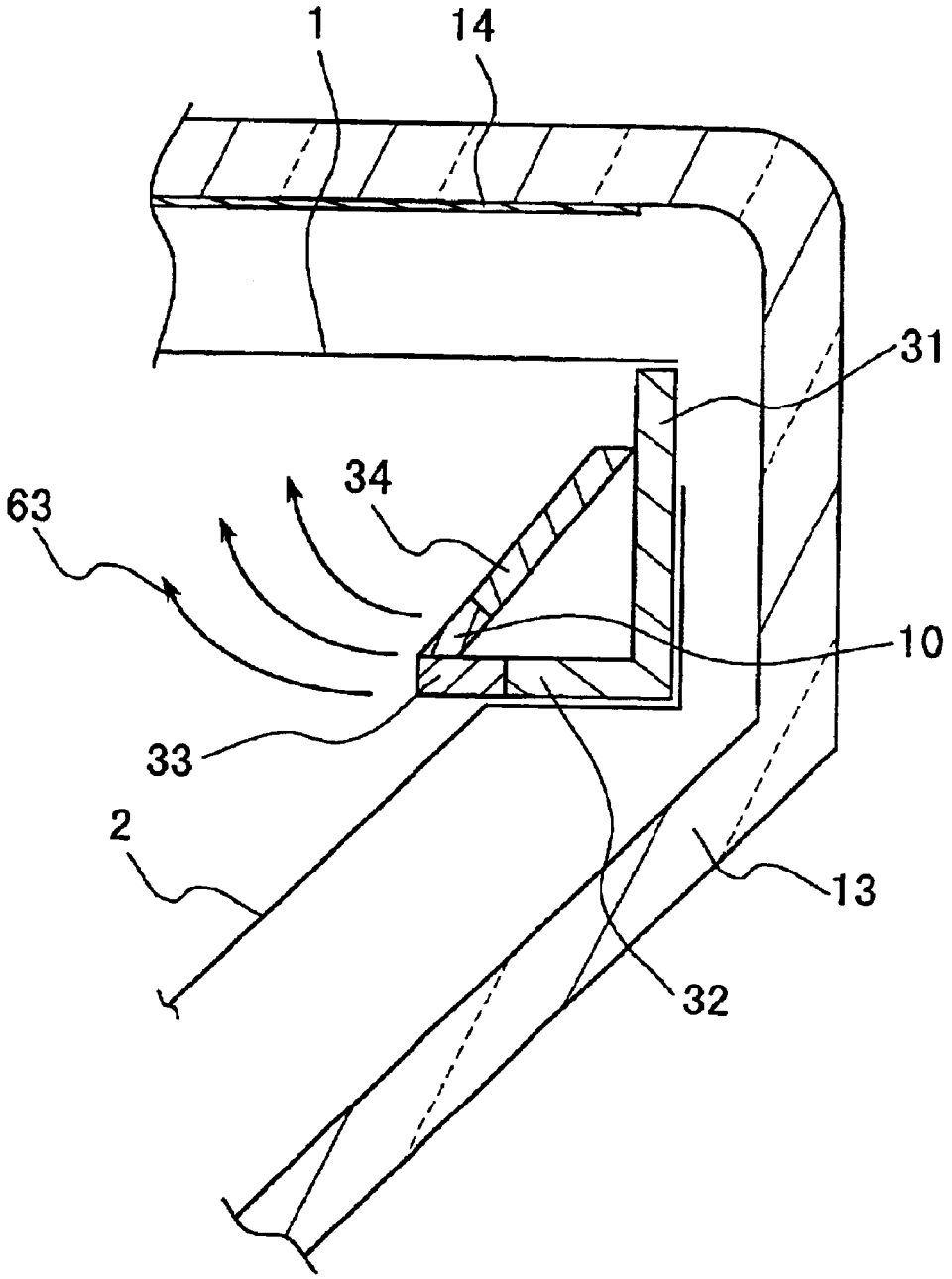
FIG. 13 shows a concept illustrating the effect of a magnetic field in the vicinity of the reinforcing member according to the fourth embodiment of the present invention.

As in FIGS. 2 and 3, FIGS. 12 and 13 schematically show the effect of a magnetic field in the mask frame 31. FIG. 12 shows a reference example, which has the electron shield 33 at the tube-axis-side edge of the inward projecting portion 32 as in the first embodiment (shown in FIG. 1). The reinforcing member 34 is made of a single material. FIG. 13 shows a configuration of the present embodiment, which is the same as that shown in FIG. 12 except that the reinforcing member 34 is constituted as above. Arrows in these figures indicate the state of a leakage magnetic field from the electron shield 33, and the thickness of these arrows corresponds to the intensity of the magnetic field.

In the configuration of the reference example of FIG. 12, the magnetic flux flowing in the electron shield 33 leaks from the electron shield 33 and the reinforcing member 34 toward the shadow mask 1 in a vacuum (a leakage magnetic field 62). On the other hand, in the present embodiment shown in FIG. 13, the reinforcing member 34 is provided with the part 10 having a smaller anhysteretic magnetic permeability than its peripheral part when the applied magnetic field is 800 A/m (10 Oe), thereby regulating and reducing the magnetic flux flowing from the inner magnetic shield 2 via the inward projecting portion 32 toward the reinforcing member 34. Thus, a leakage magnetic field 63 from the reinforcing member 34 further can be reduced. Consequently, mis-landing further can be reduced.

In the present embodiment, a central part in the longitudinal direction of the reinforcing member 34, which was provided over the entire length of the long side of the mask frame 31, was cut out in a width of 30 mm and a length (a longitudinal length of the mask frame 31) of 50 mm. Then, this cut-out part was connected with a stainless steel (having an anhysteretic magnetic permeability of about 1), thereby reducing the mis-landing on the screen by 2 μm or more compared with the configuration of FIG. 12.

For individual members other than the reinforcing member 34, the materials that are the same as those in the first embodiment can be used. For example, when the applied magnetic field is 800 A/m (10 Oe), soft iron having an anhysteretic magnetic permeability of about 12,000 can be used for the inner magnetic shield 2, Fe-36Ni, Fe-42Ni or the like having that of about 2,200 can be used for the mask frame 31, Fe-36Ni or the like heat-treated at about 570 to 640° C. having that of about 2,000 can be used for the shadow mask 1, and Fe-36Ni heat-treated at about 450° C. having that of about 1,800 can be used for the electron shield 33.

In addition, the reinforcing member 34 of the present embodiment described above may be incorporated into the configuration in which one part 9 of the electron shield 33 has a smaller anhysteretic magnetic permeability than the other part when the applied magnetic field is 800 A/m (10 Oe) (see FIG. 8) as described in the third embodiment. In this case, the electron shield 33 may be made of the same material as the mask frame 31 as in the third embodiment or of the material used in the first embodiment.

Furthermore, the reinforcing member 34 of the present embodiment may be combined with the mask frame 31 that is provided with the sheet-like electron shield 33 shown in the second embodiment (see FIG. 4).

The form of the reinforcing member 34 is not limited to that in the present embodiment, but is appropriate as long as the reinforcing member 34 has one part having a smaller anhysteretic magnetic permeability than the other part.

Fifth Embodiment

Figure 14:
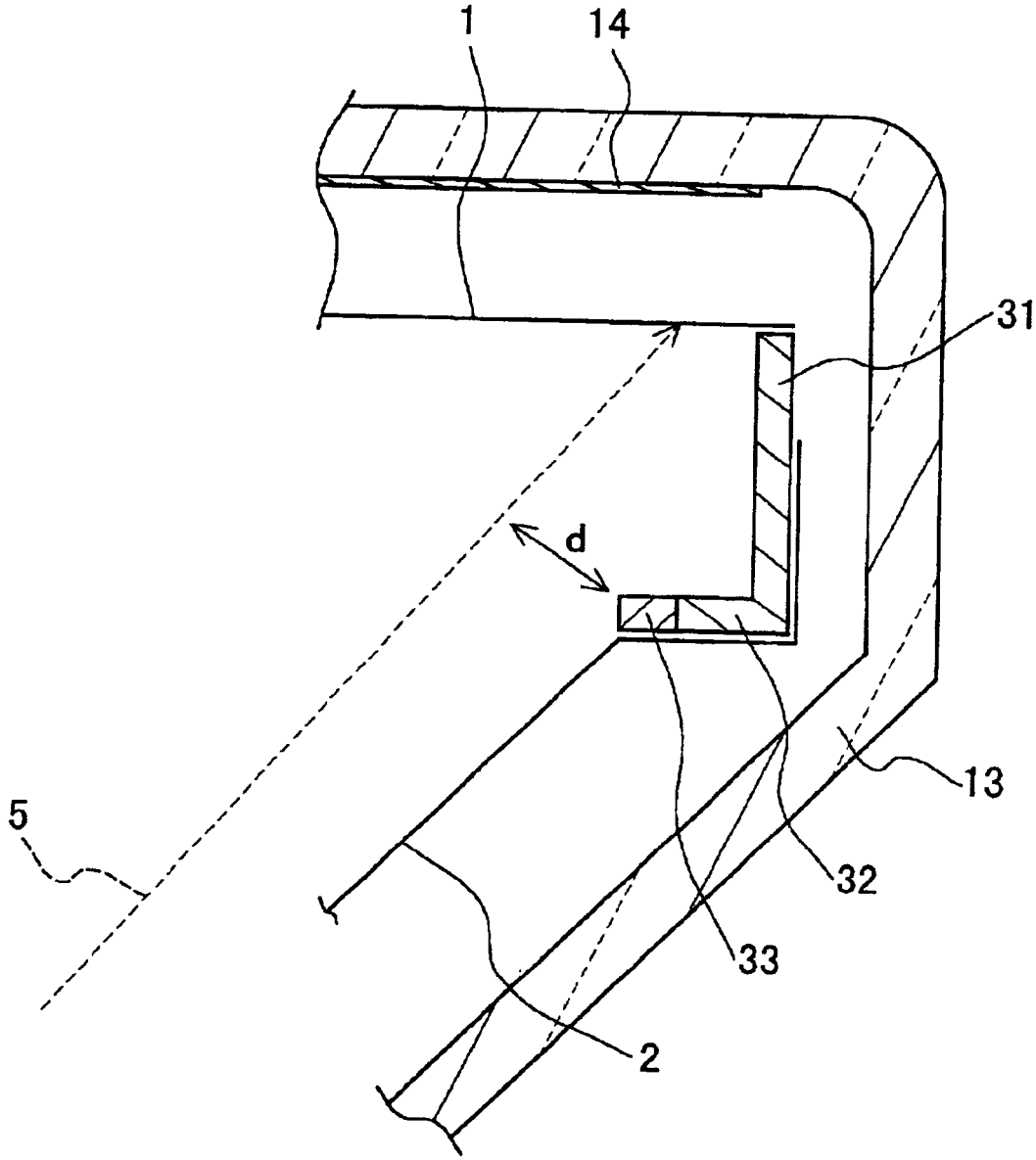
FIG. 14 shows an enlarged cross-section illustrating a main portion of a color cathode ray tube of a fifth embodiment of the present invention.

As shown in FIG. 14, in the present embodiment, a belt-like electron shield 33 having a width of 20 mm is provided at a tube-axis-side edge of an inward projecting portion 32 of a mask frame 31 so as to extend over its entire length. The present embodiment is characterized in that, when an electron beam 5 scans a phosphor screen 14 by 100%, a minimum distance d between the electron beam 5 and the electron shield 33 is at least 8 mm. In this manner, it is possible to reduce mis-landing of the electron beam on the phosphor screen.

Figure 15:
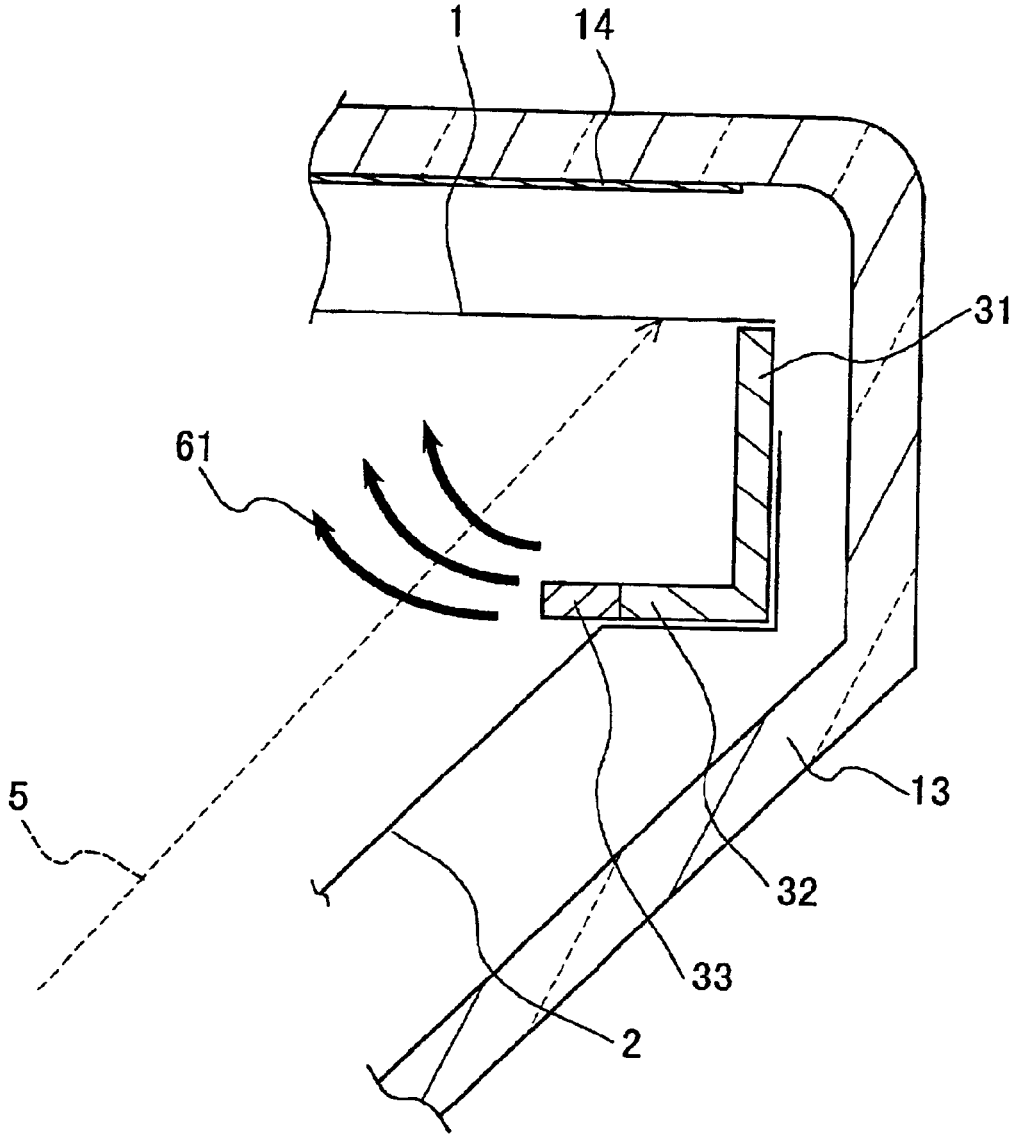
FIG. 15 conceptually illustrates an effect of a leakage magnetic field from an electron shield on an electron beam passing in the vicinity of the electron shield.
Figure 16:
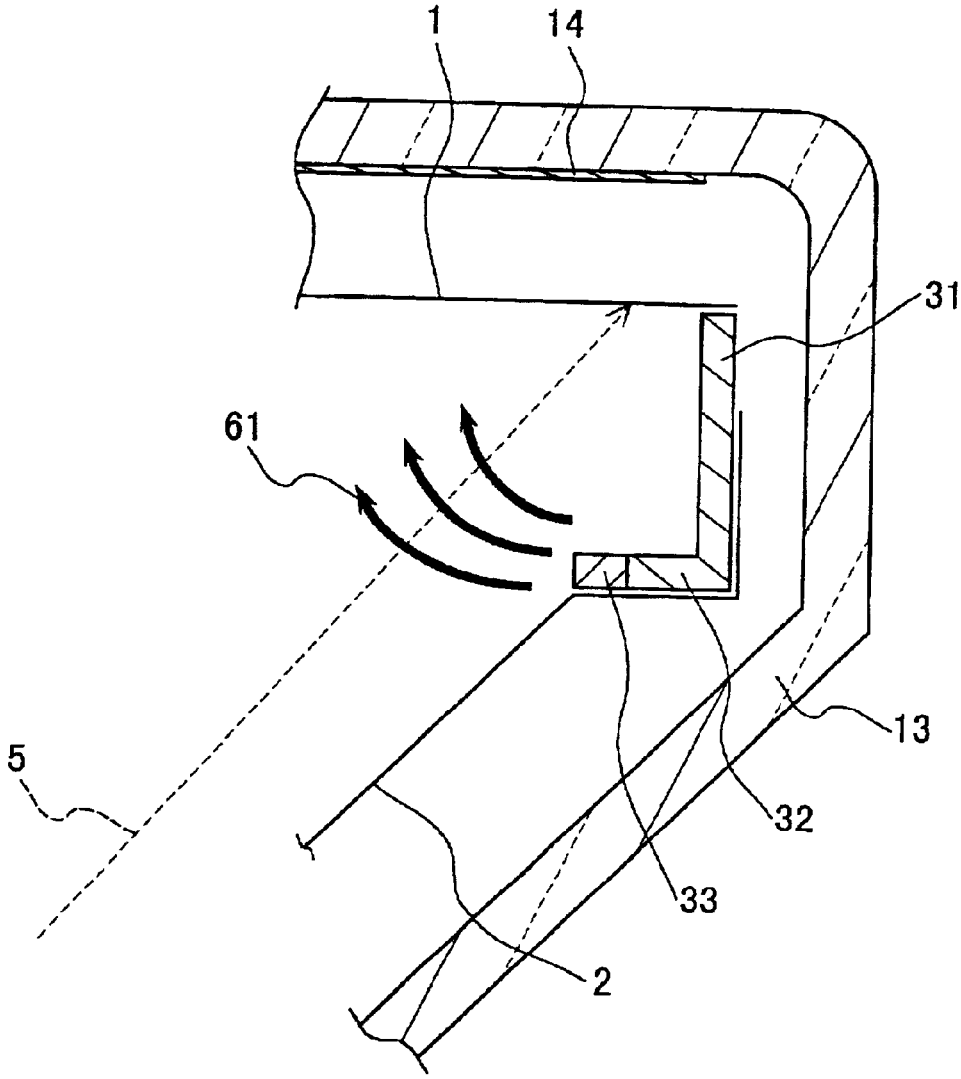
FIG. 16 conceptually illustrates the effect of the leakage magnetic field from the electron shield on an electron beam passing in a region away from the electron shield.

FIGS. 15 and 16 schematically show an effect of a magnetic field in the mask frame 31, with FIG. 15 showing the case where the minimum distance d=6 mm and FIG. 16 showing the case where the minimum distance d=10 mm. In order to make it easier to understand the effect of the present embodiment, the same material is used for the electron shield 33 and the mask frame 31 in both cases of FIGS. 15 and 16. Thus, the state of a leakage magnetic field 61 from the electron shield 33 toward a shadow mask 1 is the same in FIGS. 15 and 16. When the electron beam 5 scans the phosphor screen 14 by 100%, since the electron beam 5 passes in the vicinity of the electron shield 33 in the configuration of FIG. 15, the path of the electron beam 5 is bent by the leakage magnetic field 61, generating a considerable mis-landing. In the configuration of FIG. 16, on the other hand, even when the electron beam 5 scans the screen by 100%, the electron beam 5 passes in a region where the leakage magnetic field 61 is relatively weak, so that mis-landing is reduced. More specifically, it was possible to reduce the mis-landing on the phosphor screen by an amount of 3 μm or more in the configuration of FIG. 16 compared with that of FIG. 15.

The present embodiment has the configuration that, when the electron beam 5 scans the phosphor screen 14 by 100%, the minimum distance d between the electron shield 33 and the path of the electron beam 5 is maintained to be at least 8 mm. This configuration can be combined with any of the first to fourth embodiments described above, thereby further reducing the mis-landing on the phosphor screen 14. Thus, the materials used for the members in the present embodiment can be selected suitably from those described in the first to fourth embodiments.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color cathode ray tube comprising:

a mask frame;

a shadow mask fixed to the mask frame;

an inner magnetic shield supported by the mask frame; and an electron shield extending inwardly of the mask frame;

wherein at least a part of the electron shield is formed of a material having a smaller anhysteretic magnetic permeability than another part of the electron shield, the shadow mask, the mask frame and the inner magnetic shield when an applied magnetic field is 800 A/m (10 Oe), and the part of the electron shield having the smaller anhysteretic magnetic permeability extends to a point inward of a tube axis side edge of the mask frame.

2. The color cathode ray tube according to claim 1, wherein the electron shield is formed so as to elongate an end portion of the mask frame in a direction toward the center axis of the cathode ray tube.

3. The color cathode ray tube according to claim 1, wherein the electron shield is formed of a member different from the mask frame so as to protrude beyond an end portion of the mask frame in a direction toward the center axis of the cathode ray tube.

* * * * *